United States Patent [19]

Barnes et al.

[11] Patent Number: 4,644,626

[45] Date of Patent: Feb. 24, 1987

[54] FORMING OF METAL ARTICLES

[75] Inventors: Anthony J. Barnes, Malvern; Russell J. Stracey, Pershore, both of England

[73] Assignee: Alcan International, Ltd., Montreal, Canada

[21] Appl. No.: 768,577

[22] Filed: Aug. 23, 1985

[30] Foreign Application Priority Data

Aug. 25, 1984 [GB] United Kingdom ..... 8421634

[51] Int. Cl.[4] ..... B23D 17/00; B21D 22/10

[52] U.S. Cl. ..... 29/421 R; 72/63

[58] Field of Search ..... 72/63; 29/421 R

[56] References Cited

U.S. PATENT DOCUMENTS

| | | | |
|---|---|---|---|
| 2,317,869 | 4/1943 | Walton | 72/63 |
| 2,344,743 | 3/1944 | Smith, Jr. | 72/63 |
| 3,021,803 | 2/1962 | Lacey, Jr. | 72/63 |
| 3,566,650 | 3/1971 | Johnson | 72/63 |
| 4,145,903 | 3/1980 | Leach et al. | 72/348 |
| 4,193,285 | 3/1979 | Zumsteg | 72/60 |
| 4,409,809 | 10/1983 | Buchanan | 72/63 |
| 4,559,797 | 12/1985 | Raymond | 72/63 |

FOREIGN PATENT DOCUMENTS

| | | |
|---|---|---|
| 2113235 | 7/1971 | Fed. Rep. of Germany . |
| 563199 | 5/1975 | Switzerland . |

*Primary Examiner*—Howard N. Goldberg
*Assistant Examiner*—Steven Nichols
*Attorney, Agent, or Firm*—Browdy & Neimark

[57] ABSTRACT

Metal articles are shaped by contacting a metal blank with a diaphragm of plastically deformable metal which may be superplastic aluminium and urging the diaphragm against the blank and against a mould so that the diaphragm and body are deformed. The mould may be male or female. Thin metal articles of complex shape may be made easily and cheaply.

20 Claims, 9 Drawing Figures

FORMING OF METAL ARTICLES

This invention relates to forming of shaped metal articles and is applicable to forming of metal articles of small thickness and complex, precisely determined shape.

Thin metal components of precise shape and thickness are commonly required in the aerospace and other industrials. Production of such components by deformation of metal sheet is often difficult because of the limited capacity for plastic deformation of many metals and the production of non-uniform local thinning of the metal on stretching. When a metal sheet is extensively deformed there is also a tendency for local wrinkling to be produced.

Complex metal shapes may be made using superplastic alloys, such as the superplastic aluminium alloys described in British Pat. Nos. 1387586 and 1445181 which are capable of giving plastic deformation of several hundred percent under relatively mild deforming stresses at suitable temperatures. Deformation techniques intended to make optimum use of the properties of such alloys have been developed, such as the techniques described in British Pat. Nos. 1461317 and 1552826. However, not all types of alloy in current use can be rendered superplastic; also stretching of even superplastic metal sheet by known methods generally results in local thinning which, depending on the desired shape of the article, may not be uniform.

The present invention is intended to provide a forming method capable of producing metal articles of precisely controlled shape and thickness even when the thickness of the article is small and the degree of deformation required on forming varies widely between different parts of the article.

According to one aspect of the invention, there is provided a method of forming a shaped metal article in which a body of said metal is contacted on at least one side of the body by a sheet of a metal which is capable of being deformed plastically at an elevated temperature, a surface of said body opposite the sheet is disposed in contact with or adjacent a mould surface, and the sheet is urged against the body while the sheet is at a temperature at which it can be plastically deformed and the body is at a temperature at which it can conform to the shape of the sheet so that the body is deformed and pressed against the mould surface.

The body is denoted hereinafter as a "blank" and the sheet is denoted as a "daphragm". The mould surface may be either a male or a female mould surface. As the diaphragm is deformed towards the mould surface the blank is likewise deformed and is compressed against the mould surface so that it acquires the exact shape of the mould. During this deformation the blank is constrained by the diaphragm on one side and by the mould surface on the other so that it is compelled to flow plastically to adapt itself to both and unwanted local thinning and wrinkling are avoided.

The blank may consist of a variety of metals which may or may not be superplastic; it may be of a non-superplastic aluminium alloy. The diaphragm may consist of a superplastic metal such as superplastic aluminium alloy sold in the United Kingdom under the Trade Mark "Supral" by Superform Metals Limited. The method is especially useful for making articles from a blank of relatively small thickness, for example in the range 0.2 to 6.0 mm.

In addition to the diaphragm in contact with the side of the blank opposite the mould surface, a further diaphragm may be provided between the blank and the mould surface so that the blank is enclosed between, and constrained by, two diaphragms which are simultaneously urged against the mould.

During deformation of the blank and diaphragm the edges of the diaphragm should be constrained against movement, for example by clamping, so that the diaphragm is stretched on deformation: in contrast the edges of the blank should not be constrained. Under these conditions the blank is deformed in such a way that wrinkles and local thinning are avoided.

The method may be carried out in a variety of ways. In one embodiment the blank is in the form of a sheet of smaller area than the diaphragm and the blank and diaphragm are positioned together with the edges of the diaphragm clamped to prevent them moving but with the edges of the blank unclamped. A male mould is then advanced against the side of the blank opposite the diaphragm while the blank and diaphragm are at the temperature required for plastic deformation so that they are drawn by the mould and form a bulge around the mould with the blank in contact with part of the mould surface. Pneumatic or mechanical pressure is then exerted on the side of the diaphragm remote from the blank and mould so that the diaphragm and blank are further deformed and the blank is pressed against the remainder of the mould surface.

In this embodiment the edges of the blank may be supported, but not clamped, against the diaphragm by a stripper plate or like device and the edge of the diaphragm, on its side remote from the diaphragm, may be engaged by a draw ring surrounding the area of the diaphragm which comes into contact with the mould, the shape of the mould and the disposition of the draw ring together defining the manner in which the diaphragm and blank are deformed initially by the mould. However, it may be possible to dispense with the draw ring and control the manner of initial deformation of the diaphragm and blank around the mould by applying mechanical or pneumatic pressure to the diaphragm while the mould advances.

The same procedure may be followed when the blank is provided with a diaphragm on both sides, so that the advancing mould comes into contact with a diaphragm instead of making direct contact with the blank. In this case the edges of both diaphragms, but not the blank, should be clamped. As the blank is constrained between the two diaphragms it is possible to precede advance of the mould by a "bubble" blowing operation in which pneumatic pressure is applied to the blank/diaphragms sandwich from the same side as the mould to deform the sandwich into a dome before the male mould is applied.

In another embodiment a female mould is used and the diaphragm is clamped at its edges at the periphery of the mould whereas the blank is unclamped and positioned between the mould surface and the diaphragm. Mechanical or pneumatic pressure is then applied to deform the diaphragm and blank so that the blank is urged towards the female mould surface and acquires the shape of the mould surface. In this embodiment also a second diaphragm may be used so that the blank is constrained between the diaphragms.

Whenever two diaphragms, one on each side of the blank, are used wrinkling of the blank may be further inhibited by applying an increased ambient pressure to the blank/diaphragms so that the diaphragms are urged together to further constrain the blank throughout the deformation process. This increased pressure may be obtained by hermetically sealing the periphery of the sandwich and applying an increased atmospheric pressure during the process.

The deformation operation may generally be carried out using methods and equipment described in British Pat. Nos. 1461317 and 1552826.

The method of the invention may be used to make thin metal articles having a wide variety of shapes, including shapes involving re-entrant curves and curvature about more than one axis.

The diaphragm or diaphragms may be separated from the blank by a suitable parting agent to allow the blank and diaphragm to be separated from each other after deformation. A lubricating agent may also be applied to facilitate the slip between the diaphragm and the blank which generally occurs during deformation.

The diaphragm and blank may generally be heated to the temperature required for deformation before being disposed in the press or other device used for carrying out the deformation, and removed from the equipment while still hot to accelerate cooling.

Methods of shaping metal bodies according to embodiments of the invention will now be described by way of example with reference to the accompanying drawings in which.

Figure 1:
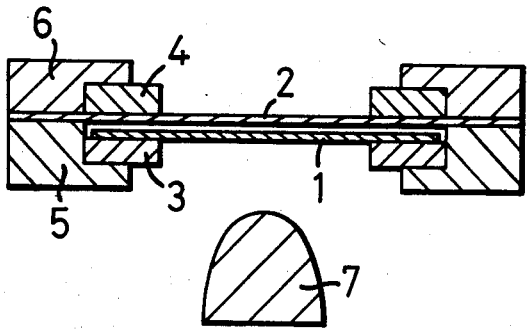
FIGS. 1 to 3 show schematically successive steps of a method of forming a shaped metal body.
Figure 2:
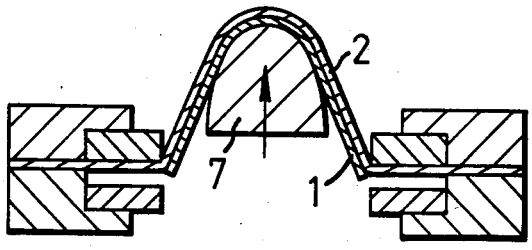
Figure 3:
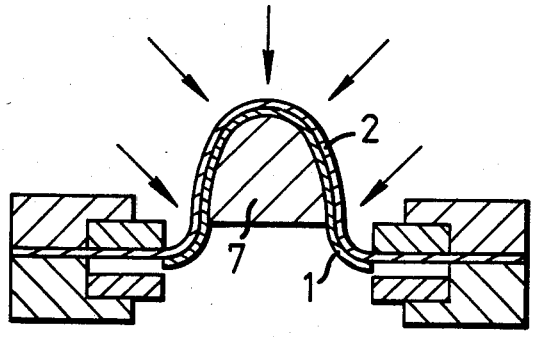

Referring firstly to FIGS. 1 to 3, a blank 1 of clad aluminium alloy known as DTD 5070B is in the form of a sheet 1.7 mm thick and is cut to the desired shape and dimensions. It is placed in a shaping machine as shown in contact with a superplastic diaphragm 2 comprising a sheet of aluminium alloy 2.5 mm thick of larger size than the blank. The blank has the alloy composition 2.5% Cu, 1.5% Mg, 1.0% Fe and 1.2% Ni by weight, remainder Al and the diaphragm the alloy composition 6.0% Cu and 0.4% Zr by weight, remainder aluminium.

The blank, preheated to 440° C., is placed with its edge parts on an annular stripper plate 3 of the shaping machine with the diaphragm, also preheated to 440° C., above it, the edges of the diaphragm extending beyond the edges of the blank and an annular draw ring is placed above the diaphragm. Clamping members 5 and 6 are applied to clamp the edge parts of the diaphragm and to clamp the draw ring 4 against the upper surface of the diaphragm; however, the stripper plate 3, while being held in place by the member 5, is not clamped against the blank but merely supports it. The edge part of the blank is thus free to move, in the plane of the blank, relative to the diaphragm.

A male forming tool 7 is then raised as shown in FIG. 2, at a rate of 10–15 mm per minute, so that the diaphragm and blank are deformed by drawing. During this step the edge part of the diaphragm remains clamped by members 5 and 6 but the edge part of the blank, being unclamped, is free to move during deformation and is drawn against the inner edge of the draw ring. The radial clearance between the male tool in its fully raised position and the draw ring is predetermined as a function of the subsequent superplastic deformation of the diaphragm.

When the tool has been fully raised air pressure is applied to the upper surface of the diaphragm so that the diaphragm is deformed superplastically and is applied around the surface of the tool as shown in FIG. 3. The blank is likewise deformed and is applied to the surface of the tool so that it conforms exactly to the tool shape. During this step the pneumatic pressure is progressively increased from zero to 110 psi (758 $KN/m^2$) over a period of 10 minutes. When the superplastic deformation of the diaphragm is complete the pneumatic pressure is released, the tool withdrawn and the hot diaphragm and shaped blank are removed from the press and separated.

During the deformation steps the blank, being constrained by the diaphragm and tool over its whole area, is deformed plastically without appreciable local thinning or wrinkling.

Figure 4:
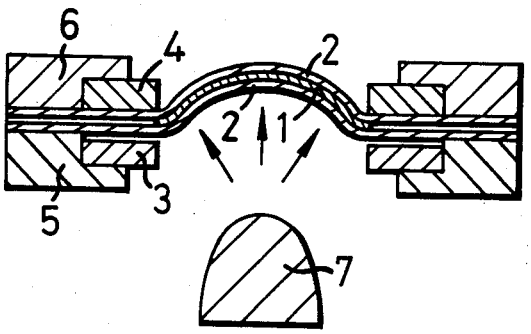
FIGS. 4 to 6 show schematically successive steps of another method of forming a shaped metal body.
Figure 5:
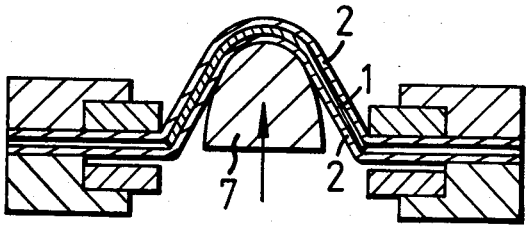
Figure 6:
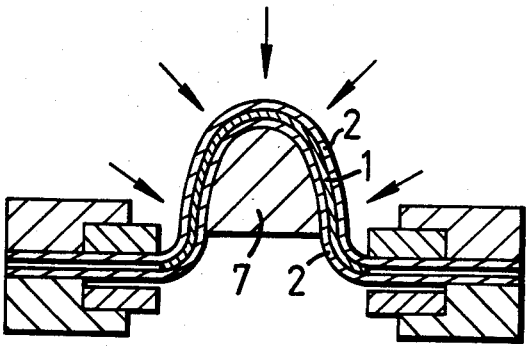

The method of shaping shown in FIGS. 4 to 6 is generally similar to that of FIGS. 1 to 3 and like numerals designate like components. However, in this case two diaphragms 2 are provided, one on each side of the blank 1, and during deformation the blank is constrained in plastic flow by both diaphragms. As for the method of FIGS. 1 to 3, the edge parts of the diaphragms are clamped between members 5 and 6 but the stripper plate and the blank are not clamped. In this method the first deformation step comprises blowing of a "bubble" by means of pneumatic pressure exerted below the diaphragms/blank assembly, as shown in FIG. 4. During this step the lower clamping member 5 forms a hermetic seal with the lower diaphragm 2. During this bubble-blowing operation the two diaphragms constrain the blank, preventing local thinning and wrinkling as the blank is deformed. The pneumatic pressure is then released and the male tool 7 raised, as shown in FIG. 5, to deform the diaphragms and blank further. Pneumatic pressure is then exerted on the upper side of the diaphragms/blank assembly (FIG. 6) to form the blank to the shape of the tool as in the embodiment of FIG. 3.

During the method of FIGS. 4 to 6 the blank is constrained to flow plastically by the two diaphragms so that local thinning and wrinkling are inhibited. These effects can be inhibited further by applying an increased background pneumatic pressure throughout the method so that the diaphragms are urged against the blank throughout the process. The edges of the blank/diaphragms assembly may be sealed before this increased pressure is applied so that the exterior pressure exceeds the interior pressure.

In the methods illustrated by FIGS. 1 to 6 it is possible to supplement the action of the draw ring in the first deformation step by applying increased pneumatic pressure above the diaphragm and blank; alternatively it may be possible to omit the draw ring and rely entirely on this pneumatic pressure to form the diaphragm/-blank assembly to its required shape around the tool.

Figure 7:
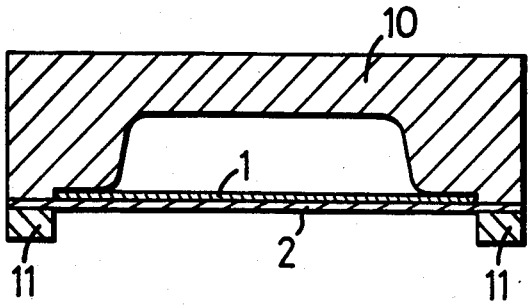
FIGS. 7 and 8 show schematically a method of forming a shaped metal body using a female mould.
Figure 8:
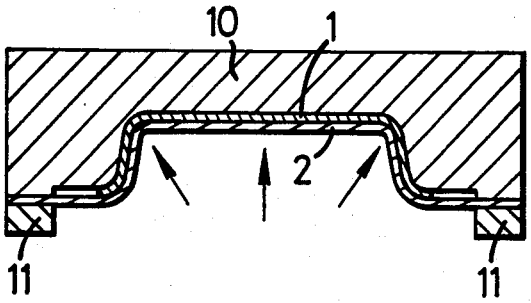

In the method shown in FIGS. 7 and 8 a female mould 10 is used and a heated assembly of blank 1 and diaphragm 2 of the same type as in the embodiment of FIG. 1 is placed over the mould: the edges of diaphragm 2 are clamped to the mould edges by clamp 11 but the edges of the blank 1 are not clamped. Pneumatic pressure is applied as shown in FIG. 8, the diaphragm is deformed superplastically and the blank is deformed to take the shape of the mould. The blank is constrained to flow plastically in the desired manner by the diaphragm and the mould surface.

The method of FIGS. 7 and 8 may also be carried out using an assembly of two diaphragms having the blank in between, as in the embodiment of FIGS. 4 to 6. The conditions of time, pressure and temperature may be generally similar to those used in the embodiment of FIGS. 1 to 3.

Figure 9:
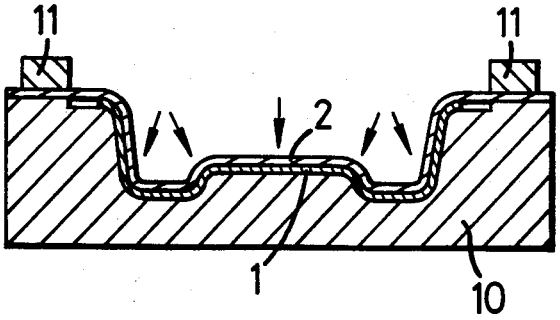
FIG. 9 shows schematically the method of FIGS. 7 and 8 applied to a mould of more complex shape.

The method of FIGS. 7 to 8 may be applied to complex re-entrant shapes, for example of the kind shown in FIG. 9.

We claim:

1. A method of forming a shaped metal article in which a body of said metal is contacted on opposite sides thereof by sheets of a metal capable of being deformed plastically at an elevated temperature, one of the sides in contact with or adjacent a mould surface, and both sheets with the body between them are urged against the body while the sheets are at a temperature at which they can be plastically deformed and the body is at a temperature at which it can conform to the shape of the sheets so that the body is deformed and pressed against the mould surface with one of the sheets between the mould surface and the body.

2. A method according to claim 1, in which said body comprises a non-superplastic aluminium alloy.

3. A method according to claim 1, in which said body has a thickness from 0.2 to 6.0 mm.

4. A method according to claim 1, in which said sheets are of superplastic metal.

5. A method according to claim 4, in which said sheets are of superplastic aluminium alloy.

6. A method according to claim 1, in which the edges of the sheets are constrained against movement during deformation.

7. A method according to claim 1, in which the sheets and body are deformed by pneumatic pressure before the surface of the body is disposed adjacent the mould surface.

8. A method according to claim 1, in which the periphery of the sheets having the body between is hermetically sealed and an increased ambient pressure is applied to the sheets during deformation.

9. A method according to claim 1, in which the mould is a male mould which is advanced against said surface of the body opposite one of the sheets and urged against the body.

10. A method according to claim 9, in which the edge of the sheet is engaged by a draw ring surrounding the area of the sheets which come into contact with the mould.

11. A method according to claim 1, in which the mould is a female mould, the sheets are clamped at the edge of the mould and the sheets and body are urged against the mould surface by pneumatic or mechanical pressure.

12. A method according to claim 1, in which a parting agent and/or a lubricating agent are applied between the sheets and the body.

13. A method according to claim 11, in which after the advance of the male mould to deform the body, pressure is applied to the side of the body remote from the mould to press the body against the mould surface.

14. A method of forming a shaped metal article in which a body of said metal is contacted on one side of the body by a sheet of metal which is capable of being deformed plastically at an elevated temperature, a surface of the body opposite the sheet is disposed in contact with or adjacent a surface of a male mould, the mould is advanced against said surface of the body to deform the portion of the body in contact with the mould, and fluid pressure is then applied to said sheet of metal to further deform the sheet and body against the mould, the sheet being at a temperature at which it can be plastically deformed and the body being at a temperature at which it can conform to the shape of the sheet.

15. The method of claim 14, wherein said body comprises a non-superplastic aluminum alloy.

16. The method of claim 14, wherein said sheet is of superplastic metal.

17. The method of claim 16, wherein said sheet is of superplastic aluminum alloy.

18. The method of claim 14, wherein the edges of the sheet are constrained against movement during deformation.

19. The method of claim 14, wherein an edge of the sheet is engaged by a draw ring surrounding the area of the sheet which comes into contact with the mould.

20. The method of claim 14, wherein a parting agent or a lubricating agent are applied between the sheet and the body.

* * * * *